US006120817A

United States Patent [19]

Archibald et al.

[11] Patent Number: 6,120,817

[45] **Date of Patent: *Sep. 19, 2000**

[54] CONTAINER FOR STORING FINE PARTICLES

[75] Inventors: William E. Archibald, Maple Grove; Rodney K. Gwiazdon, Minneapolis; George A. Tuszkiewicz, Plymouth, all of Minn.

[73] Assignee: General Mills, Inc., Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/135,319

[22] Filed: Aug. 7, 1998

[51] Int. Cl.[7] ..... B65B 33/01; B65B 85/00

[52] U.S. Cl. ..... 426/106; 426/128; 383/102; 383/103; 428/34.2

[58] Field of Search ..... 426/128, 106; 428/34.2; 383/102, 103

[56] References Cited

U.S. PATENT DOCUMENTS

| | | | |
|---|---|---|---|
| 3,302,859 | 2/1967 | Perry . | |
| 3,719,318 | 3/1973 | Moran | 229/58 |
| 4,310,118 | 1/1982 | Kisida et al. . | |
| 4,743,123 | 5/1988 | Legters et al. . | |
| 4,834,554 | 5/1989 | Stetler, Jr. et al. | 383/100 |
| 5,059,036 | 10/1991 | Richison et al. | 383/61 |
| 5,120,585 | 6/1992 | Sutter et al. | 428/34.2 |
| 5,171,950 | 12/1992 | Weiss et al. . | |
| 5,281,027 | 1/1994 | Thrall | 383/88 |
| 5,314,702 | 5/1994 | Lewandowski et al. . | |
| 5,388,910 | 2/1995 | Koyanagi | 383/100 |
| 5,590,777 | 1/1997 | Weiss et al. . | |
| 5,804,265 | 8/1998 | Saad et al. | 428/35.2 |

FOREIGN PATENT DOCUMENTS

| | | |
|---|---|---|
| 0136859 | 4/1985 | European Pat. Off. . |
| 0524539 | 1/1993 | European Pat. Off. . |
| 8127809 U | 1/1982 | Germany . |
| 9426605 | 11/1994 | WIPO . |

*Primary Examiner*—Nina Bhat
*Attorney, Agent, or Firm*—John A. O'Toole; Douglas J. Taylor; Alan D. Kamrath

[57] ABSTRACT

The present invention is a container for storing fine particles in a sealed packaging, wherein air in the container can be evacuated through compression or vacuum without removing the fine particles. The container comprises a main body enclosing a pouch, terminating in a principal opening, a sealing mechanism attached to the pouch for sealing the pouch, at least one exit port extending through the wall of the pouch, and a porosity mechanism adjacent the exit port, wherein the porosity mechanism permits air to exit through the exit port, but prevents the fine particles from escaping through the exit port.

19 Claims, 8 Drawing Sheets

CONTAINER FOR STORING FINE PARTICLES

FIELD OF THE INVENTION

The present invention relates to sealed containers. More specifically, the present invention relates to containers such as plastic bags for storing fine particles such as flour, wherein the containers can be compressed or evacuated to remove excess air content without leaking the fine particles.

BACKGROUND OF THE INVENTION

A variety of fine particle dry powders such as baking products (e.g., flour, baking powder, baking soda, and powdered sugar) are packaged in paper or cardboard containers. Paper and paperboard containers permit the above products to be packaged with a lower content of air than would occur with different containers such as plastic bags. Such containers are highly porous and/or are self venting. The above baking products are not packed in plastic bags because plastic bag containers trap air that is difficult to evacuate from the plastic bag without evacuating a portion of the baking product in the plastic bag at the same time.

Conventional paperboard and paper containers, however, have numerous deficiencies. For example, the traditional paper container for flour can be damaged or infiltrated by numerous environmental factors. The paper tends to absorb moisture that contacts the paper. The moist paper becomes a breeding ground for mold and mildew that can damage the flour. The moisture also causes the paper fibers to expand and weaken, making it easier for the paper container to tear open. The paper container is also susceptible to insect infestation. Numerous types of insects will easily chew completely through the paper.

In addition, because of the porous nature of paper, various odors and particles can pass through the paper resulting in a less fresh flour product. The porous nature of the paper also permits moisture to migrate out from the flour product to outside the paper container. This is an especially acute problem when flour is stored in an environment having a low humidity or dew point level. Flour normally has a moisture content of about 14%. In order to compensate for the expected loss of moisture, flour producers actually overfill the paper container to ensure that the product still weighs the amount listed on the packaging after being exposed to a drier environment and losing a certain amount of moisture content. Although only a small amount of overfill is required, the cost to the manufacturer is very significant when you consider the millions of tons of flour that is packaged and sold in the world. Moreover, environmental desiccation can adversely affect the flour's baking properties thereby undesirably leading to a consumer perception of low or poor flour product quality.

The paper containers are also not desirable from a shipping standpoint. When the paper container is filled with flour, the flour becomes aerated, taking up a greater volume of space. The additional space taken up by the aerated flour costs money. In addition, the general rectangular/cylindrical shape of the flour container causes problems with stacking and moving. Complicating the stacking problem is the uneven distribution of flour within the paper container. For example, a first paper container of flour is stacked on top of a second paper container of flour. The weight of the first container causes a downward, compressive force on the second paper container of flour. The air in the second paper container, however, cannot completely escape from the sealed paper container. The result is that the second paper container becomes an unstable, bulging foundation for the first paper container. The problem is exacerbated when a third paper container of flour is stacked on top of the first paper container of flour, creating additional downward force on the second paper container. Unstable stacks of flour containers can be extremely dangerous during shipping. Shifting loads can tip over tractor trailer trucks or fall on top of workers.

Conventional paper flour containers are also not desirable for consumer use. Paper containers are not resealable, thus, the consumer must place the contents into another container in order to prevent the contents from spilling, absorbing moisture or bug infestation. Opening paper containers of flour can also be messy. The conventional method of sealing a paper container involves gluing or seaming a series of folds at the top and bottom of the container. During the sealing process, flour becomes caught between the various folds. When the paper container is opened at the top, the flour caught in the folds, spills onto the counter. Also, such paper flour containers lack an easy-to-open feature. In addition, the shape of the paper container is not generally conducive to baking. Specifically, the tall cylindrical shape is not stable and tends to fall over easily. Moreover, the top end of the container that is opened to access the flour usually folds back onto itself, making entry and removal of a scoop difficult. The shape of the paper container is also a difficult shape to handle with only one hand. The paper container also makes it nearly impossible to tell how much flour is left in the paper container without actually having to look inside the container.

The conventional paper flour container is also not economically efficient to the consumer. Flour becomes trapped in the bottom folds inside the paper container, depriving a consumer of some of the flour product purchased. In addition, similar to the problem faced by the shipper, the consumer has difficulties stacking paper containers of flour. Even if the consumer transfers the flour in the paper container to a plastic bag, the flour cannot be stacked because the air trapped in the plastic bag is difficult to evacuate out of the plastic bag without evacuating some of the flour at the same time.

Paperboard packaging poses similar problems. Paperboard is susceptible to water damage. Paperboard containers, although rigid, can also cause shipping problems. The rigid shape prevents a manufacturer from evacuating all of the air out of the container. Excess space is, therefore, taken up during shipping. The manufacturer cannot evacuate all of the air out of the container, thus, after the product eventually settles, there is an air pocket inside the cardboard container. The air pocket causes a portion of the cardboard container not to be supported by the product. The lack of support allows the cardboard to be more easily dented or crushed. A crushed wall of a cardboard container can cause a load of cardboard boxes to become unstable and either shift or collapse. Paperboard containers usually do not seal close, but are closed with a flap. The lack of a tight seal allows moisture, mold and insects to penetrate the container. In addition, cardboard containers are not transparent. This prevents a consumer from being able to view whether the container is full without having to open the container.

Plastic bags have long been used for dry powders having a generally larger particle size such as conventional granular sugar. However, such bags generally include at least one opening such as a notch or pin hole to provide for air escape during packaging to provide an aspirated plastic bag. While such pinhole containing or perforated plastic bags are useful for particulate materials having a larger particle size, such as regular sugar, such perforated containers are unsuitable for use with fine powders such as baking flour. As the plastic bag is compressed during processing to expel any entrapped air, some amount of fine flour materials can be carried along with the air through the perforations. The expelled flour dust presents numerous sanitation negatives. More importantly, airborne flour dust is highly explosive and presents an extreme safety hazard.

Imperforate conventional plastic bag containers are not practical for fine particle baking products either. Imperforate bags that have air in them are not practical for shipping. They balloon up, are unstable and take up additional space. In order to evacuate the air out of the bag, the air is either compressed out of the bag or it is vacuumed out of the bag prior to complete sealing. With fine particles, however, some of the particles get compressed out the bag or sucked out of the bag through the vacuum mechanism. Even if the manufacturer successfully evacuates air out of the plastic container, the consumer, however, normally does not possess a vacuum device or compression device to evacuate air after opening the bag. Consequently, the consumer, after the bag has been opened, has a bulky, ballooned-up bag.

Conventional containers for holding fine particle baking products are not desirable for shipping, storage or consumer use. A container for holding fine particles that can be sealed and resealed, but can easily have air evacuated out of it without removing the fine particles, is desired.

SUMMARY OF THE INVENTION

In its article aspect, the present invention includes a container for holding fine particles comprising a main body having a pouch terminating in a principal opening. The pouch has an inside surface and an outside surface. Attached to the pouch adjacent the principal opening is a sealing mechanism. The sealing mechanism provides a sealed access point to the inside surface of the pouch through the principal opening. Extending from one end at the inside surface to another end at the outside surface of the pouch is an exit port.

The exit port could be located anywhere on the pouch. A porosity mechanism is secured across at least one end of the exit port. Generally, the porosity mechanism is a screening valve that allows trapped air in the pouch to exit while preventing predetermined sized particles from exiting the pouch.

In its method aspect, the present methods provide methods for making a container for holding fine particles.

selecting a sheet of material of predetermined area, the sheet having an edge about its perimeter;

installing an exit port through the sheet;

securing a porosity mechanism over the exit port;

folding the sheet onto itself to form two major opposing surfaces;

sealing the opposing surfaces along all but a portion of the edge to form a pouch, the unsealed edge forming a principal opening; and securing a resealable sealing mechanism to both major surfaces adjacent the principal opening, the resealable sealing mechanism sealing the pouch unless unsealed.

BRIEF DESCRIPTION OF THE DRAWINGS

The above-mentioned objects and advantages can be more clearly seen by referring to the following detailed description and the drawings in which.

DETAILED DESCRIPTION OF THE INVENTION

For convenience, like numbers have been used to identify like parts.

Figure 1:
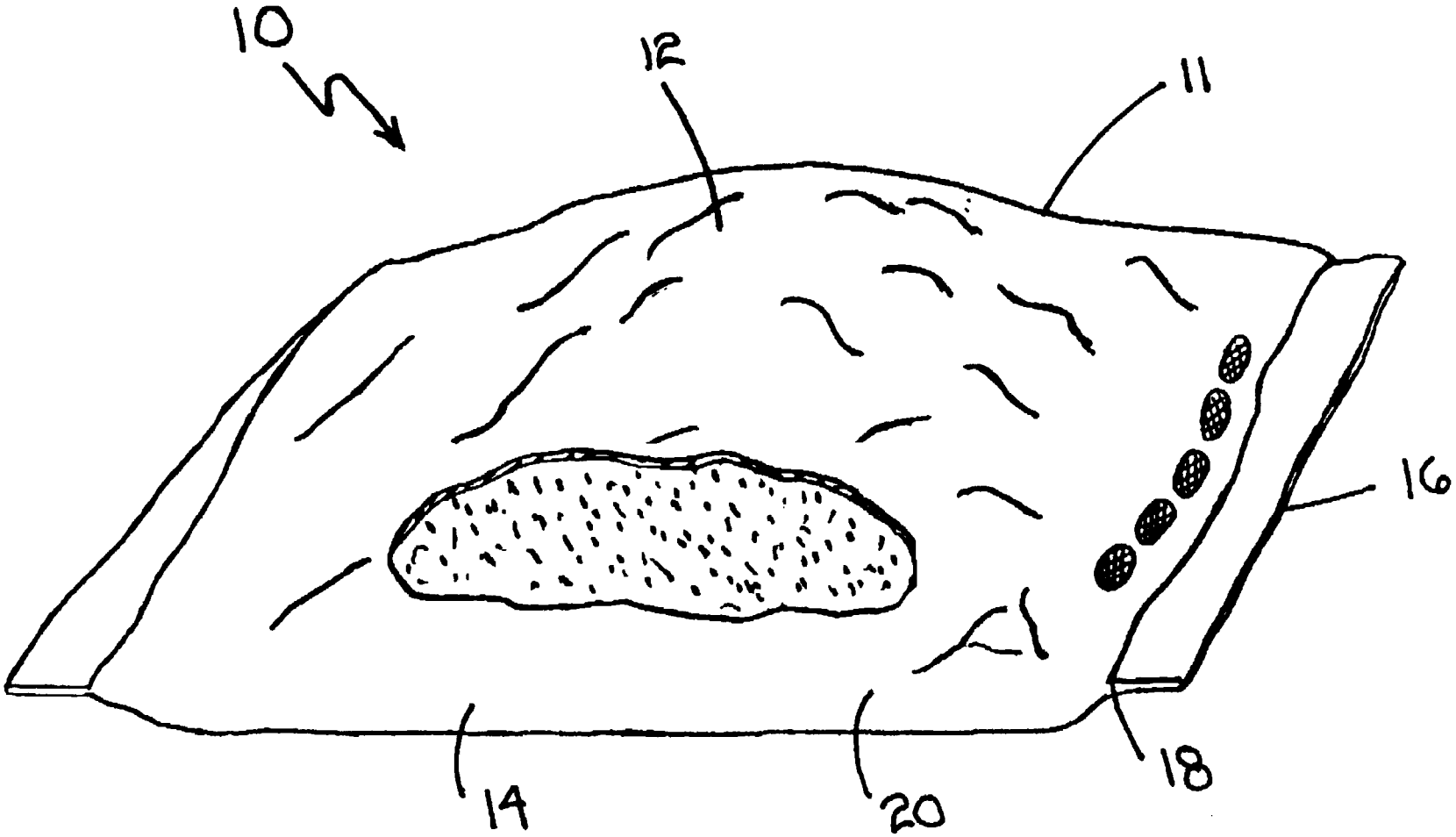
FIG. 1 is a perspective view of one preferred embodiment of the present invention showing a container filled with particles.

Referring now to the drawings, FIG. 1 depicts a container 10 for storing fine particles 12 (not shown). FIG. 1 shows container 10 lying on its side in an orientation suitable for stacking such as on a grocery shelf. FIG. 1 shows that container 10 includes a main body 11 for holding fine particles 12, said main body 11 forming an interior region or a pouch 14 and terminating at a principal or top opening 16 sealed with a closure means such a sealing mechanism 18. Body 11 has a flexible outside surface 20 and, opposite outside surface 20, inside of pouch 14 an inside surface 22. Extending through pouch 14, from outside surface 20 to inside surface 22, is at least one exit port 24. Adjacently covering at least one end of exit port 24 is a porosity mechanism 26.

While the present improved container can be used for packing of a wide variety of sized wet and dry materials, containers 10 find particular suitability for use for packing of fine dry particles 12. Fine particles include both edible materials such as foodstuffs and inedible materials. Suitable edible materials include, for example, sugar (especially powdered sugar), flour, starch, salt, cocoa, baking powder, non-fat dry milk solids, protein powders, instant tea or coffee. These materials can be separate or admixed to form dry mixes such as for layer cakes, muffins, or other baked good or dry mixes for beverages, e.g., hot chocolate. Inedible materials could include cement, dry adhesives, ground gypsum, diatomaceous earth or any other fine powder, especially those typically packaged in small quantities (0.1 to 5 kg). Containers 10 find particular suitability for dry materials wherein at least a portion (e.g., 5% >) have a particle size of less than 500 micron (500 $\mu$m).

Of course, containers 10 can be used to package larger sized materials, edible or inedible, e.g., rice, dried beans or lentils, ready-to-eat cereals, if desired.

Preferably, pouch 14 comprises an imperforate, non-porous flexible material such as polypropylene and/or polyethylene plastic film. The flexible material can be a single layer or can be laminated. The film material can be a polymer, co-polymer or melt blends of various plastics. In less preferred embodiments, the film material can be or include a metal foil, cellophane, glassine, greaseproof or parchment paper.

Sealing mechanism 18, in a closed position, prevents particles 12 from exiting pouch 14 as illustrated in FIG. 1. When sealing mechanism 18 is closed, principal opening 16 is also closed. Sealing mechanism 18 preferably comprises at least a resealable sealing mechanism such as the zipper mechanism found on Zip-Loc® storage bags. The zipper mechanisms can either be formed in pouch 14 adjacent principal opening 16 or be separate strips of material that are secured to pouch 14 adjacent principal opening 16 by a heat seal 28, as shown in FIG. 2.

Figure 2:
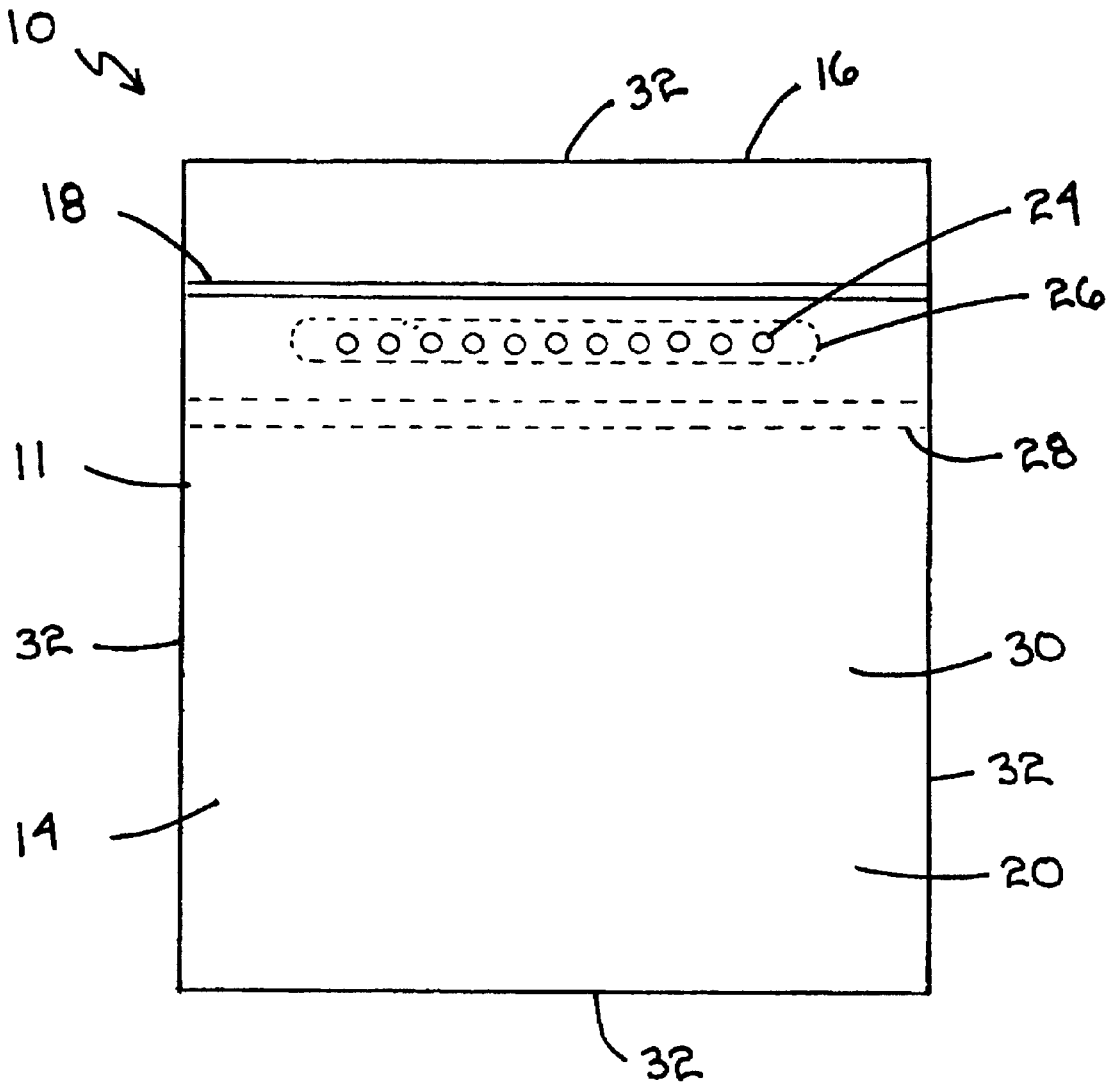
FIG. 2 is a front view of one embodiment of a first major surface of the present invention.

In one embodiment, main body 11 has a first major surface 30, as illustrated in FIG. 2. In this embodiment, first major surface 30 is generally rectangular in shape. First major surface 30 can also be fabricated to have either regular shapes (e.g., geometric shapes) or irregular shapes. Edges 32 extend about the perimeter of first major surface 30. Upper free edge 32?, adjacent sealing mechanism 18, forms part of principal opening 16. Lower free portion of edge 32 can be continuous with major surface 30 or can be a lap seal or a fin seal such as depicted in FIG. 1.

Figure 3:
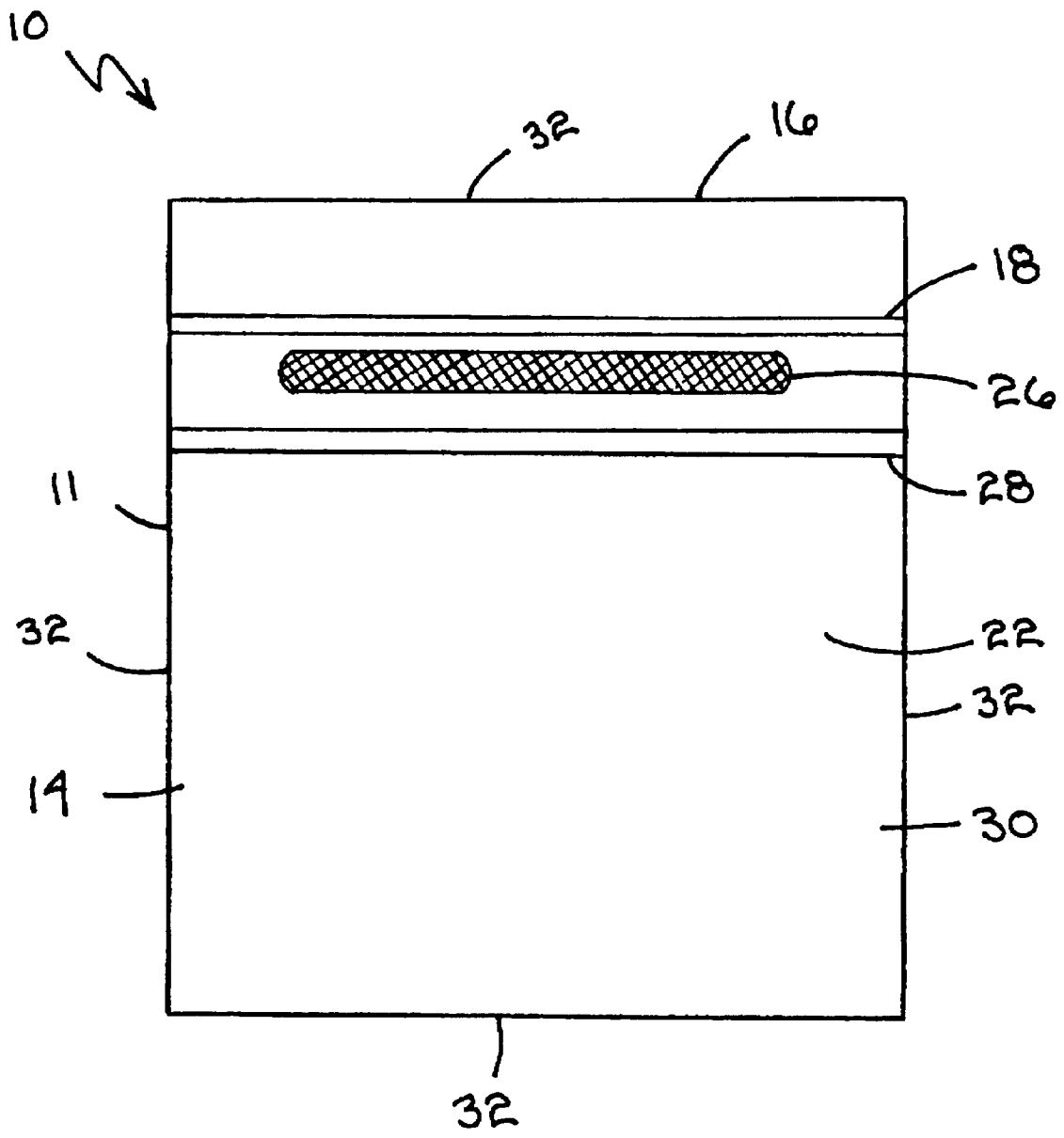
FIG. 3 is an inside view of one embodiment of the first major surface of the present invention.

Secured to inside surface 22 is porosity mechanism 26, as illustrated in FIG. 3. Porosity mechanism 26 can be, if desired, placed adjacent exit port 24 as depicted in FIG. 3. Porosity mechanism 26 is a mechanism that functions to allow trapped air 34, not shown, but not other particles 12 in pouch 14, to be expelled when the container is squeezed, i.e., forced, out of pouch 14 when sealing mechanism 18 is sealing pouch 14. Trapped air 34 passes through porosity mechanism 26 out through exit port 24to form an aspirated container.

Porosity mechanism 26 can have a different porosity depending on the size of the particle 12 being stored in pouch 14. The larger the particle size of fine particles 12, the greater the porosity can be of porosity mechanism 26. Some examples of possible porosity mechanisms 26 would be perforated strips and nonwoven fabrics. Preferably, porosity mechanism 26 is of a design that it does not become clogged with particles 12 when trapped air 34 is being squeezed out of pouch 14 which clogging could impede the expiration of the entrapped air. Porosity mechanism 26 can be located adjacent an exit port 24 anywhere on pouch 14. Preferably, porosity mechanism 26 is located near an edge 32. By locating porosity mechanism 26 near an edge 32, exit port 24 and porosity mechanism 26 can expel trapped air 34 when a second container 10 is stacked on top of first container 10. Although porosity mechanism 26 has generally been described as being used for finely ground solid particulates baking products such as flour and powdered sugar, porosity mechanism 26 and container 10, generally, are also applicable to liquid applications. Porosity mechanism 26 only has to have a low enough porosity to allow trapped air 34 molecules to pass through, but not liquid molecules (e.g., using a Gore-tex type fabric).

Figure 4:
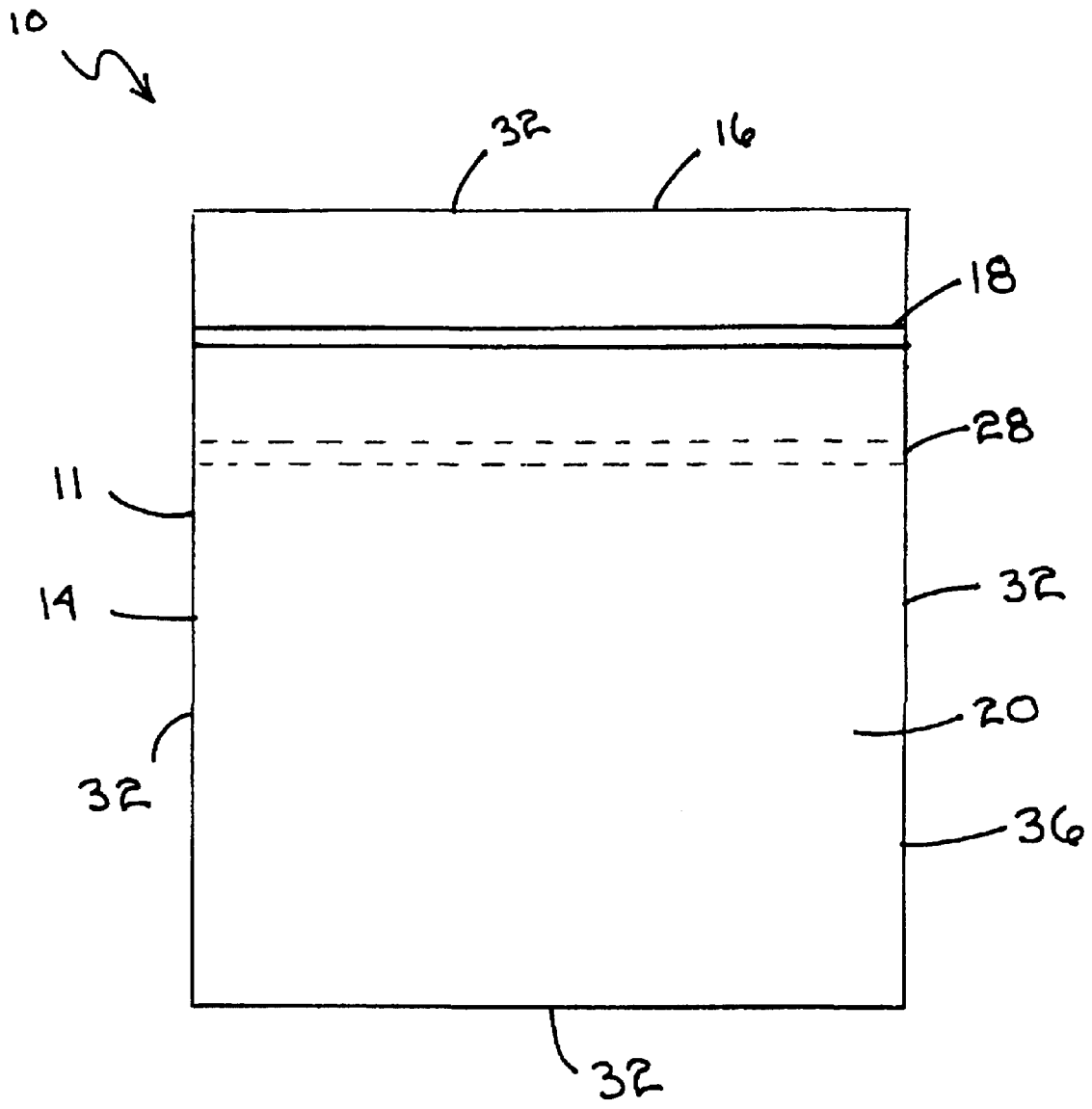
FIG. 4 is a front view of one embodiment of a second major surface of the present invention.

A second major surface 36 of main body 11, is illustrated in FIG. 4. Second major surface 36 and opposing first major surface 30 are sealed along three portions of edges 32 to form pouch 14.

Figure 5:
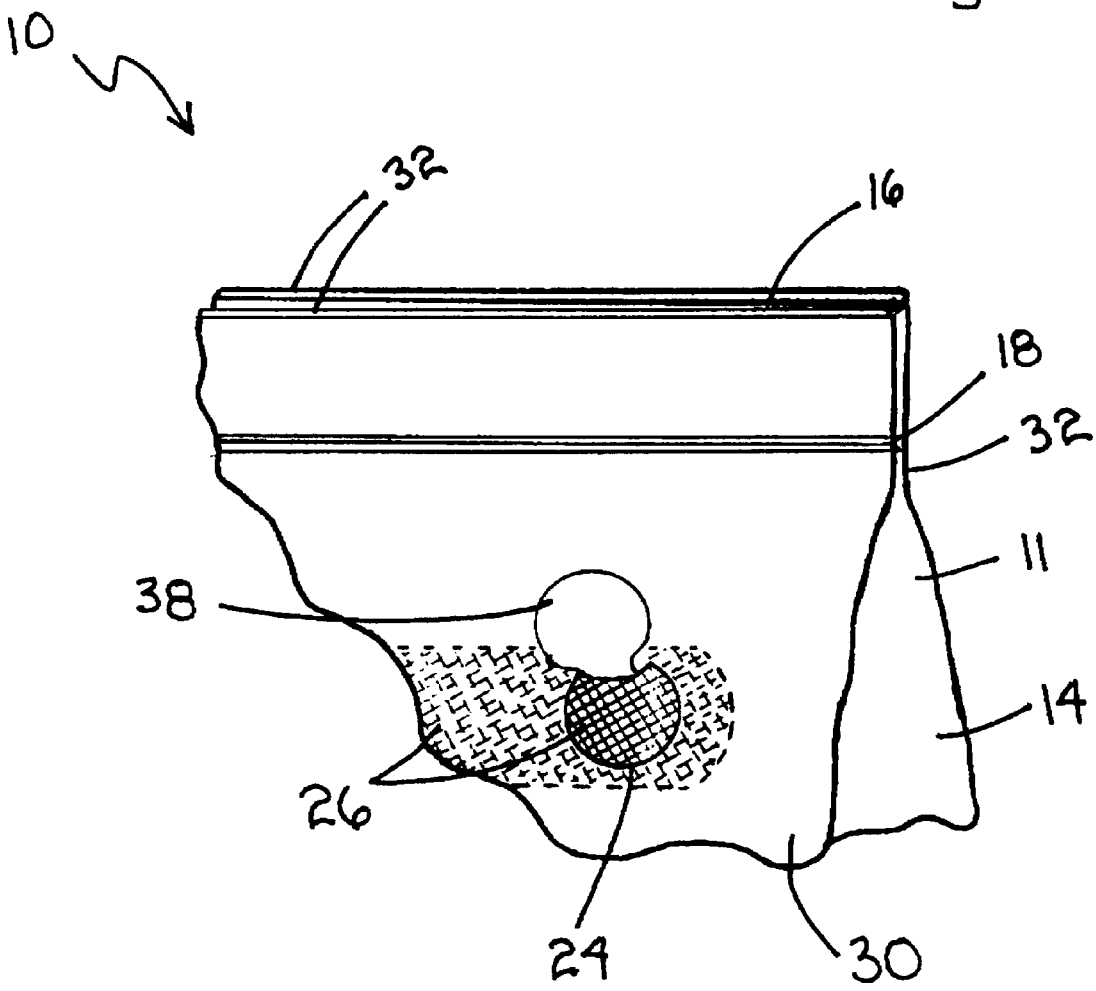
FIG. 5 is an enlarged, greatly cut-away sectional view of one embodiment of a flap and an exit port of the present invention.

In one embodiment of the present invention, a flap 38 is formed into and attached to pouch 14 overlaying exit port 24, as illustrated in FIG. 5. Flap 38 is designed to prevent environmental factors such as moisture, air, odors, and insects from gaining access into pouch 14 through porosity mechanism 26. In the embodiment shown in FIG. 5, flap 38 flips open and away from porosity mechanism 26 when trapped air 34 is being squeezed out of pouch 14. After trapped air 34 is squeezed out of pouch 14, flap 38 flips back down to cover exit port 24 and porosity element 26.

Figure 6A:
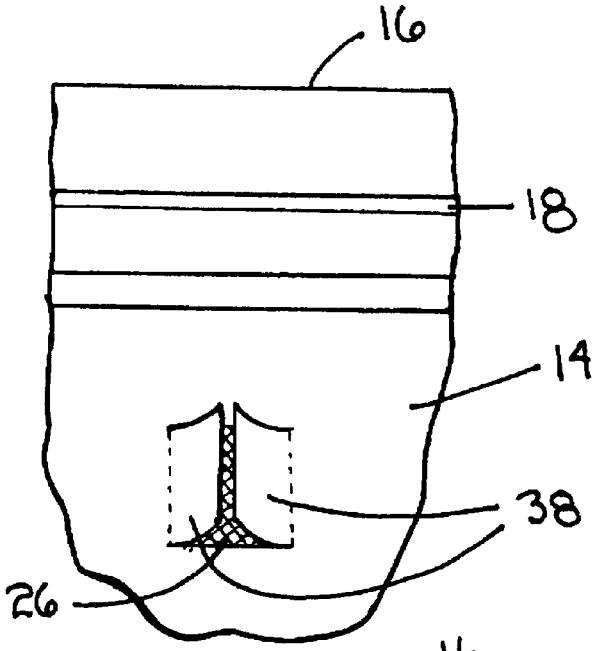
FIGS. 6*a*, 6*b*, and 6*c* are close up, sectional views of three different embodiments of flap and exit port configurations.
Figure 6B:
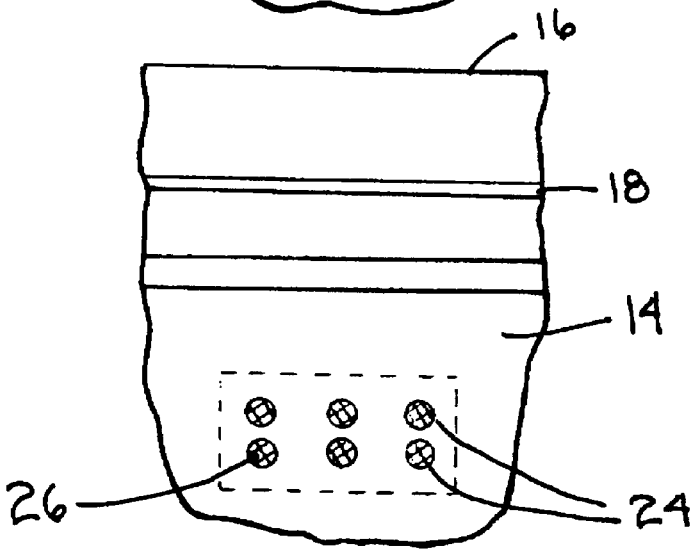

Various embodiments of exit port 24 configurations are possible. One embodiment of flap 38 is a dual-door embodiment, as shown in FIG. 6*a*. In this embodiment, flap 38 would be a pair of adjacent shutters that swing open when trapped air 34 is forced out of exit port 24. Flap 38 would fall back in front of exit port 24 after trapped air 34 is expelled from pouch 14. Exit port 24 does not have to be a single large hole, but can be a large quantity of small apertures as shown in FIG. 6*b*.

Figure 6C:
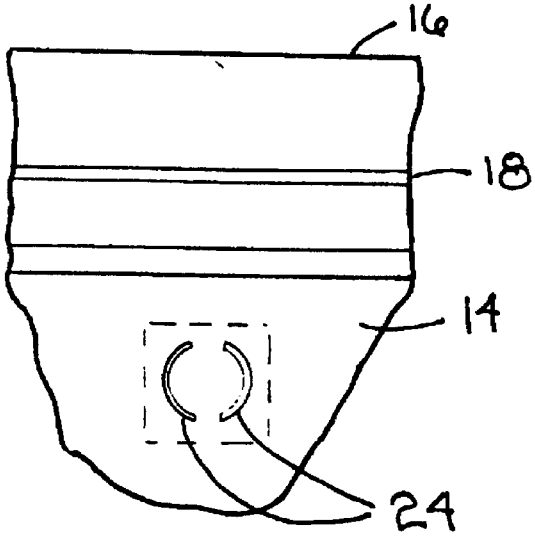

Furthermore, exit port 24 does not have to be round, but can take other shapes, such as the "C" die-cut pattern illustrated in FIG. 6*c*.

Figure 7:
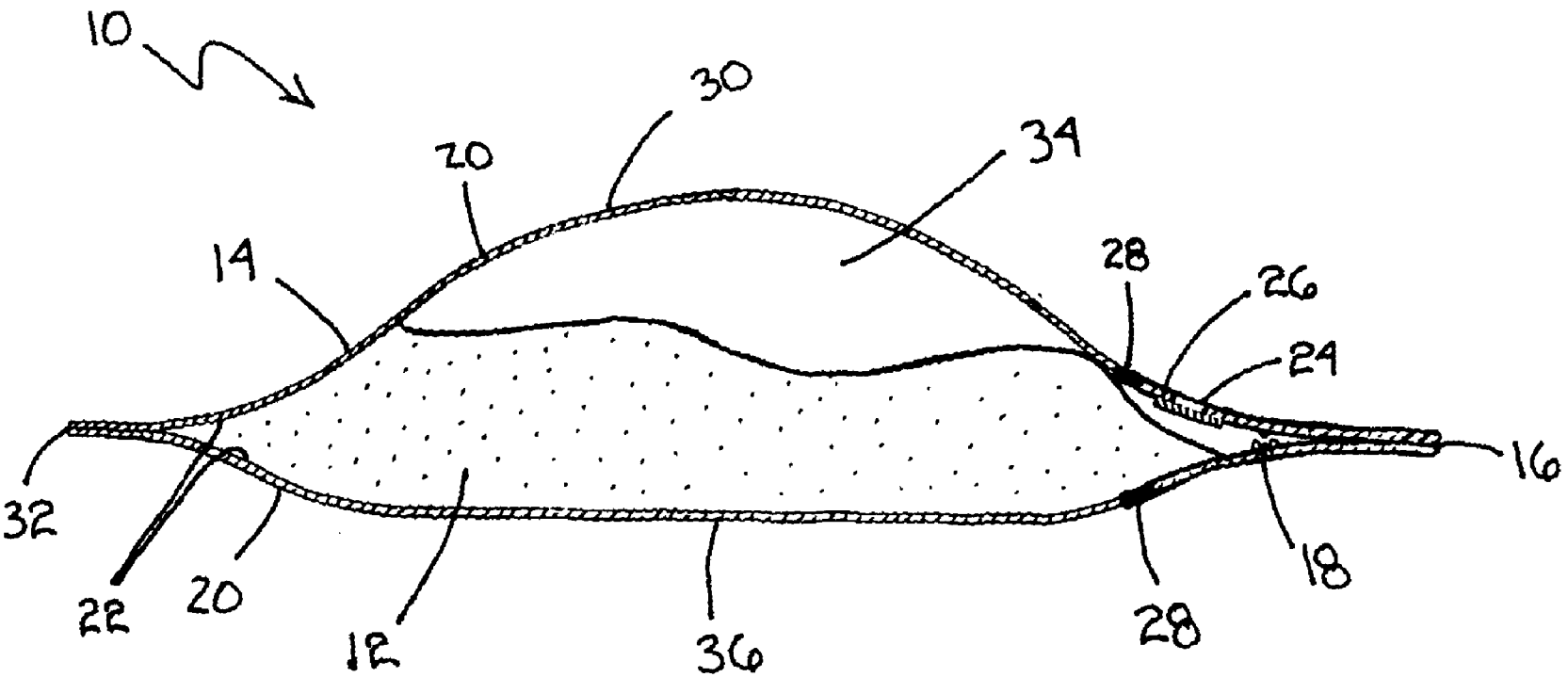
FIG. 7 is a sectional view of one embodiment of the present invention showing fine particles and air trapped in the pouch.
Figure 8:
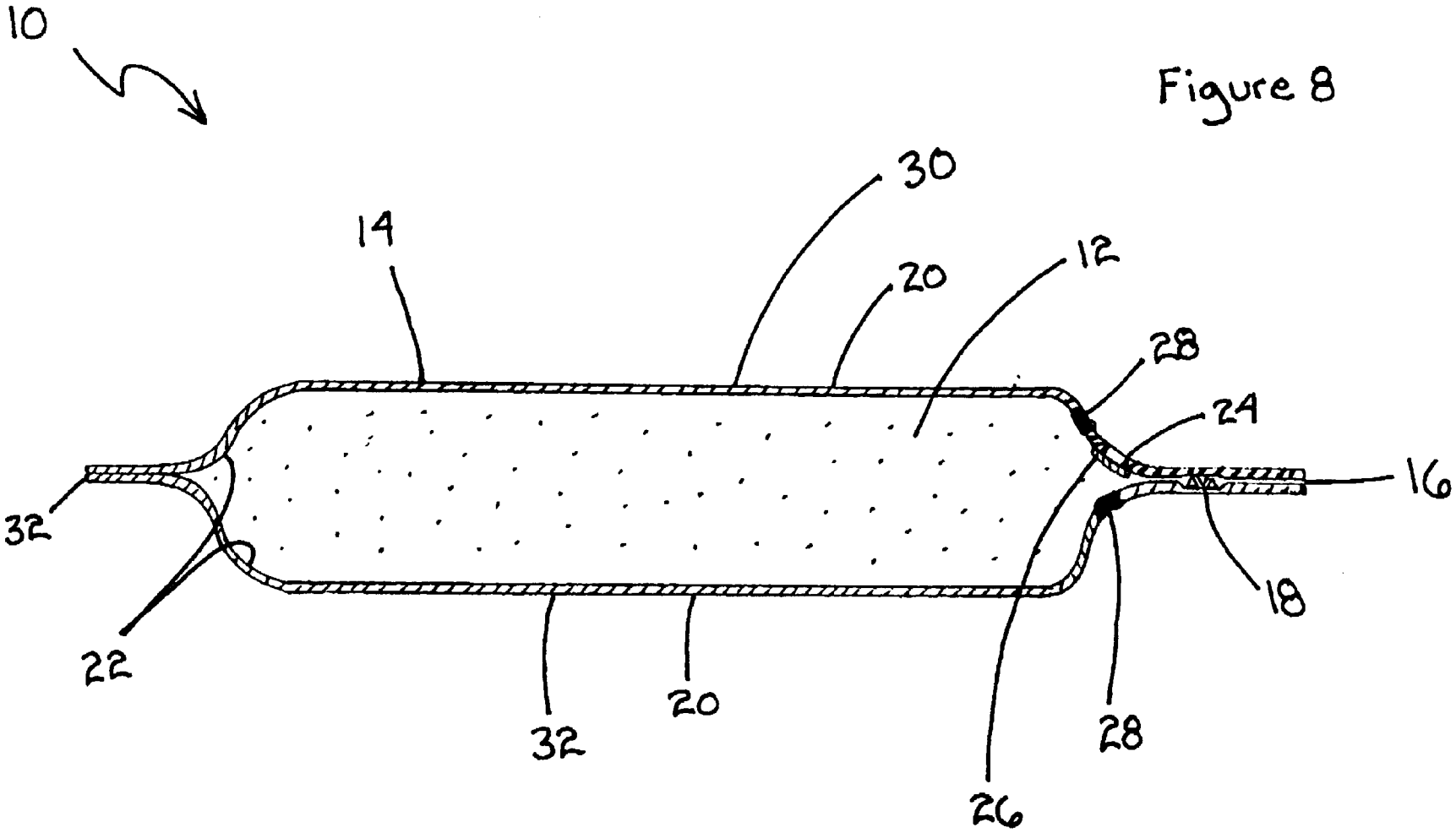
FIG. 8 is a sectional view of one embodiment of the present invention showing fine particles with air removed from the pouch.

Porosity mechanism 26 would allow trapped air 34, as illustrated in FIG. 7, to be evacuated out of container 10 without removing particles 12. In an embodiment where sealing mechanism 18 includes a resealable seal, trapped air 34 could be removed from container 10 after each time sealing mechanism 18 is opened and closed, as illustrated in FIG. 8.

A rectangular shaped first major surface 30 and second major surface 36 allows container 10 to lay flat on a counter. Several containers 10 could be stacked on top of each other. The added weight from each additional container 10 could be used to further compress lower containers 10. The flat configuration of container 10 would be safer for shipping. The lower profile would be less likely to shift in transport. The removal of trapped air 34 results in a smaller volume of space being taken up by container 10.

The lower profile and smaller space of container 10 would be more desirable to consumers. Container 10 would take up less space in the kitchen. A container 10, made of clear plastic in one embodiment, would allow a consumer to see how much material was in container 10 without having to open up sealing mechanism 18.

The rectangular shape of first major surface 30 and second major surface 36, allows pouch 14 to be opened quite wide, permitting easy access of a scoop. Container 10 can be manufactured without folds, preventing particles 12 from getting caught and either spilling on the counter or remaining trapped in the bottom of container 10.

Container 10 in one embodiment is comprised of plastic that is less susceptible to insect and moisture penetration. Similarly, the plastic material prevents moisture in particles 12 from escaping from pouch 14. Producers would not have to overfill container 10 in order to compensate for moisture loss, because little moisture loss would occur.

Having illustrated and described the principles of the present invention in the preferred embodiments it will be apparent to those skilled in the art that the invention can be modified in arrangement and detail without departing from such principles. We claim all modifications coming within the scope and spirit of the following claims.

It is claimed:

1. A container for holding fine particles, the container comprising:

a main body, the main body defining a pouch terminating in at least one principal opening, the pouch fabricated from a flexible imperforate, plastic material having an inside surface and an outside surface;

a sealing mechanism disposed on the pouch adjacent the principal opening, the sealing mechanism closing the principal opening preventing migration of the particles from the pouch;

at least one exit port in the pouch, the exit port extending across the pouch and from the inside surface to the outside surface; and an elongated porosity mechanism, the porosity mechanism being attached to and extending across at least a substantial portion of the pouch, with the porosity mechanism adjacently covering the exit port.

2. The container as claimed in claim 1, wherein the main body comprises a pair of major opposing surfaces.

3. The container of claim 2, wherein the main body includes a plurality of exit ports extending across the pouch, with the porosity mechanism extending across each of the plurality of exit ports.

4. The container of claim 3 wherein the pouch is rectangular in shape.

5. The container of claim 2, wherein at least a portion of the sealing mechanism is resealable.

6. The container of claim 5 wherein the sealing mechanism comprises a permanent seal and a resealable seal adjacent the permanent seal.

7. The container of claim 6, wherein the porosity mechanism is secured on the inside surface of the pouch.

8. The container of claim 7, wherein the porosity mechanism comprises a woven material.

9. The container of claim 7, wherein the porosity mechanism comprises a non-woven material.

10. The container of claim 7, wherein the porosity mechanism comprises a perforated material.

11. The container of claim 7, further including at least one flap attached to the outside surface of the pouch in a cantilevered manner, the flap adjacent the exit port.

12. The container of claim 6 additionally comprising a quantity of contained material disposed within the pouch.

13. The container of claim 12 wherein the contained material is a dry particulate.

14. The container of claim 13 wherein the dry particulate comprises an edible foodstuff.

15. The container of claim 14 wherein at least a portion of the edible foodstuff is in the form of a powder.

16. The container of claim 15 wherein the edible foodstuff includes a member selected from the group consisting of flour, sugar, starch, cocoa, salt, baking powder, non-fat dry milk solids, and mixtures thereof.

17. The container of claim 16 wherein the porosity mechanism is secured on the inside surface of the pouch.

18. The container of claim 17 wherein the porosity mechanism comprises a non-woven material.

19. A plastic container for holding fine particles, the container comprising:

a main body, the main body defining a pouch terminating at a principal opening, the pouch having an inside surface and an outside surface opposite the inside surface, the inside surface comprising a pair of major opposing surfaces, the major opposing surfaces each having four edges along their respective perimeters, the four edges of each major surface forming four pairs of opposing edges, the major surfaces being sealed together along three pairs of opposing edges, the fourth pair of opposing edges forming the principal opening;

a resealable sealing mechanism, the resealable sealing mechanism secured to the fourth pair of edges;

at least one exit port in the pouch, the exit port extending from the inside surface to the outside surface;

at least one cantilevered flap adjacent the exit port, the flap being secured to the pouch and adapted to extend over the exit port; and a porosity mechanism secured to the inside surface adjacent the exit port and extending across the exit port.

* * * * *